US012686424B2

(12) United States Patent
Christie

(10) Patent No.: US 12,686,424 B2
(45) Date of Patent: Jul. 21, 2026

(54) RAILWAY COMMUNICATIONS SYSTEM

(71) Applicant: Jack Christie, Penshurst (AU)

(72) Inventor: Jack Christie, Penshurst (AU)

( * ) Notice: Subject to any disclaimer, the term of this patent is extended or adjusted under 35 U.S.C. 154(b) by 0 days.

(21) Appl. No.: 18/876,022

(22) PCT Filed: Jun. 22, 2023

(86) PCT No.: PCT/AU2023/050572
§ 371 (c)(1),
(2) Date: Dec. 17, 2024

(87) PCT Pub. No.: WO2023/245251
PCT Pub. Date: Dec. 28, 2023

(65) Prior Publication Data

US 2026/0015020 A1 Jan. 15, 2026

(30) Foreign Application Priority Data

Jun. 22, 2022 (AU) ..... 2022901706

(51) Int. Cl.
*B61L 27/70* (2022.01)
*B61L 15/00* (2006.01)
(Continued)

(52) U.S. Cl.
CPC ..... *B61L 27/70* (2022.01); *B61L 15/0027* (2013.01); *B61L 15/0036* (2013.01);
(Continued)

(58) Field of Classification Search
CPC ..... B61L 27/70; B61L 15/0036; B61L 23/34; B61L 15/0027
See application file for complete search history.

(56) References Cited

U.S. PATENT DOCUMENTS 7,770,847 B1 * 8/2010 Severson ..... A63H 19/24 246/5
2007/0001058 A1 * 1/2007 Severson ..... A63H 19/24 246/1 R (Continued)

FOREIGN PATENT DOCUMENTS

DE 102004023154 B4 3/2006

OTHER PUBLICATIONS

International Search Report and Written Opinion issued for International Application No. PCT/AU2023/050572 dated Sep. 4, 2023, 26 pages.

(Continued)

*Primary Examiner* — Long T Tran
(74) *Attorney, Agent, or Firm* — Husch Blackwell LLP

(57) ABSTRACT

Described herein is a rail-based system (1000) for communication between a plurality of railway vehicles. The system (1000) comprises a contact (100) adapted for providing an electrical connection between at least one of the plurality of railway vehicles (2000) and at least one rail track (3000); a transceiver (102) associated with at least one of the plurality of railway vehicles (2000). The transceiver (2000) is adapted to transmit and/or receive an electrical signal by way of the contact (100) from the at least one of the plurality of railway vehicles (2000) to and/or from the at least one rail track (3000). The electrical signal is transmitted and/or received over the at least one rail track (3000) to communicate between the plurality of railway vehicles (2000). The transceiver (102) is adapted to adjust a power output of the electrical signal to determine a distance between the plurality of railway vehicles (2000) and the power output of the electrical signal is derived based on a function of one or both of a headway, and/or power input.

20 Claims, 7 Drawing Sheets

(51) Int. Cl.
*B61L 23/04* (2006.01)
*B61L 23/34* (2006.01)
*B61L 25/02* (2006.01)

(52) U.S. Cl.
CPC ..... *B61L 23/044* (2013.01); *B61L 23/34* (2013.01); *B61L 25/026* (2013.01); *B61L 25/028* (2013.01); *B61L 2205/04* (2013.01)

(56) References Cited

U.S. PATENT DOCUMENTS

2008/0297144 A1 12/2008 Schweizer
2010/0171609 A1 7/2010 Yeldell et al.
2011/0183605 A1* 7/2011 Smith, Jr. ..... B61L 15/0027 455/7
2012/0078452 A1 3/2012 Daum et al.
2012/0263460 A1* 10/2012 Movassaghi ..... H04B 10/40 398/38
2013/0334373 A1 12/2013 Malone, Jr. et al.
2014/0142868 A1* 5/2014 Bidaud ..... G01N 21/8803 702/34
2015/0031306 A1 1/2015 Lundquist et al.
2015/0302752 A1 10/2015 Holihan et al.
2016/0068173 A1* 3/2016 Fuchs ..... B61L 25/04 340/994
2016/0359741 A1* 12/2016 Cooper ..... H04W 4/44
2018/0141452 A1* 5/2018 Hourtane ..... B60L 53/32
2020/0290482 A1* 9/2020 Jones ..... B60K 1/00
2020/0361433 A1* 11/2020 Raj ..... B60T 17/228
2022/0204061 A1* 6/2022 Woo ..... B61L 3/10
2023/0271637 A1* 8/2023 Kernwein ..... B61L 27/16 701/19

OTHER PUBLICATIONS

Extended European Search Report for European Patent Application No. 23825699.4, dated May 6, 2026, 13 pages.

* cited by examiner

RAILWAY COMMUNICATIONS SYSTEM

FIELD OF THE INVENTION

The present application relates to systems for communications between rail vehicles and in particular, to systems for assisting drivers, or automated driving systems, in maintaining a safe distance between rail vehicles.

Embodiments of the present invention are particularly adapted for use with light or heavy rail vehicles. However, it will be appreciated that the invention is applicable in broader contexts and other applications.

BACKGROUND

Presently, systems for preventing the collision of rail vehicles utilize track-based circuits utilizing a variety of fixed, physical communication mediums that are usually adapted to communicate between fixed equipment in a rail network such as signals, points, interlockings and other equipment. Present systems have an overreliance on the amount of fixed assets that need to be installed, maintained, and replaced.

For instance, there is more track infrastructure than there are trains, and track maintenance/upgrades require extensive planning, approval and typically must be completed within limited timeframes to reduce the impact on the network. In contrast, trains can be worked on during their routine cleans, check-ups and maintenance schedules, as well as when they are stabled during off peak times.

It is desirable to have a railway signalling system that is not overly reliant on the physical environment in which it operates.

Any discussion of the background art throughout the specification should in no way be considered as an admission that such art is widely known or forms part of common general knowledge in the field.

SUMMARY OF THE INVENTION

In accordance with a first aspect of the present invention, there is provided a rail-based system for communication between a plurality of railway vehicles, the system comprising:

- a contact adapted for providing an electrical connection between at least one of the plurality of railway vehicles and at least one rail track;
- a transceiver associated with the at least one of the plurality of railway vehicles, the transceiver being adapted to transmit and/or receive an electrical signal by way of the contact from each of the plurality of railway vehicles to and/or from the at least one rail track; and
- wherein, the electrical signal is transmitted and/or received over the at least one rail track to communicate between the plurality of railway vehicles;
- wherein the transceiver is adapted to adjust a power output of the electrical signal to determine a distance between the plurality of railway vehicles; and
- wherein the power output of the electrical signal is derived based on one or both of a headway, and/or power input.

In one embodiment, the distance between the plurality of railway vehicles is determined using the formula:

$$D = \frac{Z_m - Z_a}{2Z_u} = \frac{\frac{V_i - V_o}{I_o} - Z_a}{2Z_u}$$

wherein D equals a distance between the transceiver associated with the at least one of the plurality of the railway vehicles (in metres), Vi is the input voltage of the transceiver, Vo is the voltage received by the transceiver and Io is the current measured in Amperes.

In one embodiment, the transceiver is adapted to adjust a power output of the electrical signal across a predefined range of values. The adjustment may be in a continuous or discrete manner. The adjustment of power may be by way of a change in voltage or current.

In one embodiment, the power output of the electrical signal is derived through a mathematical function of either a headway, a power input or a combination of the power input and the headway.

In one embodiment, the mathematical function further depends on at least a parameter of the plurality of railway vehicles, including but not necessarily limited to; the perceived alertness of a human driver (obtained through vigilance systems), weather conditions which would affect safe travelling speeds, gradient of track, curvature of track, whether or not authority to move has been granted to the vehicle by a higher operational entity (e.g., a network controller), presence of additional hazards such as worksites, incident scenes, infrastructure faults.

In one embodiment, the power output of the electrical signal is proportional to a headway of the plurality of railway vehicles.

In one embodiment, the system further includes a transceiver installed trackside to communicate with the transceiver associated with the plurality of railway vehicles.

In one embodiment, the railway vehicle is adapted to adjust the headway, braking conditions, velocity and/or acceleration depending on parameters of at least one of the plurality of railway vehicles, including but not necessarily limited to; relative acceleration, relative velocity.

In one embodiment, the railway vehicle is adapted to adjust the headway, braking conditions, velocity and/or acceleration depending on parameters of at least one of the plurality of railway vehicles, including but not necessarily limited to; relative acceleration, relative velocity.

In one embodiment, the transceiver is adapted to produce a modulated signal.

In one embodiment, the transceiver is adapted to use latency measurements with respect to delays in transmission time to determine a distance between the plurality of railway vehicles.

In one embodiment, the transceiver is adapted to measure the electrical characteristics of the rails between two transceivers, to determine a distance between the plurality of railway vehicles.

In one embodiment, the transceiver is adapted to measure or utilise the doppler effect to calculate the relative distance, speed, velocity and/or acceleration to determine a distance between the plurality of railway vehicles.

In one embodiment, the transceiver is adapted to adjust output power of the electrical signal to increase/decrease with a distance that the electrical signal travels.

In one embodiment, the electrical signal is alternatively transmitted utilising overhead wiring (OHW).

In one embodiment, GNSS, GPS or other satellite based geodesic geolocation systems is used to aid in locating the plurality of railway vehicles.

In one embodiment, Cellular or telephony communications technologies (including GSM, CDMA, LTE and 5G NR or any telecommunications technology which utilises MPLS or ATM) are used to aid in locating the plurality of railway vehicles, or as an alternative method of communication between the plurality of railway vehicles.

In one embodiment, IP based communications technologies (including those that conform to, or are designed based on the principles of, one or more of the 802 family of standards) are used to aid in locating the plurality of railway vehicles, or as an alternative method of communication between the plurality of railway vehicles and/or other fixed systems.

In one embodiment, NFC communications technologies are used to aid in locating the plurality of railway vehicles, or as an alternative method of communication between the plurality of railway vehicles and/or other fixed systems.

In one embodiment, the system is used alongside or in conjunction with traditional signalling systems (which can be classed as having a grade of automation of 0) as an ancillary method of protection, an additional safety system and/or to aid in locating the plurality of railway vehicles.

In one embodiment, the system is used alongside or in conjunction with modern signalling technologies (ETCS, ETRMS, CBTC, PTC or any other railway signalling system, or component which forms part of a railway signalling system, which has a grade of automation of 1 or higher) as an ancillary method of protection, an additional safety system and/or to aid in locating the plurality of railway vehicles.

In one embodiment, the contact is adapted for providing an electrical connection between each of the plurality of railway vehicles and at least one rail track.

BRIEF DESCRIPTION OF THE FIGURES

Example embodiments of the disclosure will now be described, by way of example only, with reference to the accompanying drawings in which.

DESCRIPTION OF EMBODIMENTS OF THE INVENTION

Figures 1A, 1B:
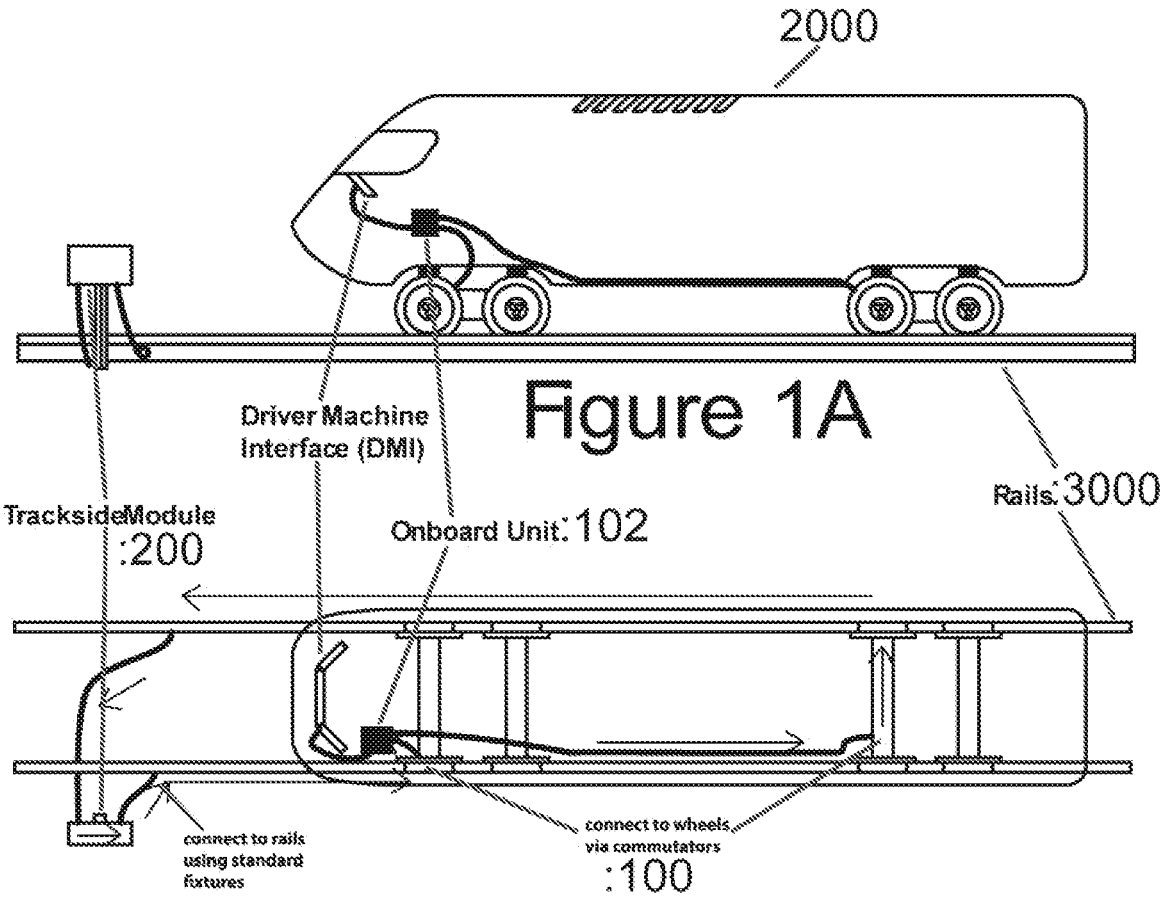
FIG. 1A shows a side view of the system in use.
FIG. 1B shows a bottom view of the system in use.

It should be noted in the following description that like or the same reference numerals in different embodiments denote the same or similar features.

A rail-based system communication between a plurality of railway vehicles, in accordance with an embodiment of the present invention is generally indicated by 1000. In the embodiment shown in FIGS. 1A and 1B, the system comprises a contact 100 adapted for providing an electrical connection between a plurality of railway vehicles 2000 and at least one rail track 3000. The system 1000 further comprises a transceiver 102 which is associated with the plurality of railway vehicles 2000. In some embodiments, a transceiver 102 is located some or all of the plurality of railway vehicles. In other embodiments, at least one transceiver 102 may be positioned at a location near to or adjacent the railway tracks.

The transceiver 102 may take the form of a transmitter, a receiver or both a transmitter and receiver. In order to communicate with other railway vehicles 2000, the transceiver 102 is adapted to transmit an electrical signal using a variety of modulation schemes and transmission protocols as will be discussed in more detail below. The electrical signal carries information which is used to communicate with railway vehicles 2000 within the vicinity of other railway vehicles 2000.

In order to determine a distance between adjacent railway vehicles 2000, the transceiver 102 is adapted to adjust a power output of the transceiver 102 which forms the basis for determining the distance between two or more railway vehicles 2000 based on the following mathematical formula:

$$D = \frac{Z_m - Z_a}{2Z_u} = \frac{\frac{V_i - V_o}{I_o} - Z_a}{2Z_u} = \frac{\frac{(\Delta V)^2}{\Delta P} - Z_a}{2Z_u} \qquad \text{Formula 1}$$

Where D equals a distance between the two transceivers (in metres) $V_i$ is the input voltage of the transceiver, $V_o$ is the voltage received by the transceiver (both Voltage), $\Delta V$ is the relative change in voltage measured across the two rails, $\Delta P$ is the power dissipated in the circuit (and by proxy, the power output of the transceiver), Io is the current measured in Amperes.

The power output may be determined as a function of the input power and a headway.

$Z_m$ is the measured impedance between the two terminals of the first transceiver (in the units of Ohms (Ω)), $Z_a$ is a summation of any known impedance or resistance (Ω) within the electrical circuit besides the rails (such as that of the axles and commutators) and $Z_u$ is the standard impedance per unit length of rail (i.e. Ω/m).

In other embodiments, the power output of the electrical signal is derived through a mathematical function of either a headway, a power input or a combination of the power input and headway.

In relation to Formula 1 described above, the voltages $V_i$ and $V_o$ are independent controlled variables, whilst $I_o$ is a dependent variable. Mathematically, there are other methods and models which can be utilised to determine D. However, in all cases, given the main independent uncontrolled variable are impedances, Ohms law requires either the input voltage, input current or both, to be controlled variables. Hence, due to Watt's law, the input power from the transmitting part of the transceiver ($P_i = V_i \times I_i$) must be adjustable and controllable to determine the distance between railway vehicles 2000.

The transceiver 102 may be located within the cabin of the railway vehicle 2000 or attached externally to the railway vehicle 2000. The transceiver 102 may be powered by its own power source such as a battery or may be adapted to take power from the power infrastructure associated with the railway vehicle 2000.

For instance, in order to provide for reliable communications, in one embodiment, the transceiver 102 is adapted to produce a modulated AC carrier signal in order to transmit data (or a power signal) over the at least one rail track 3000. This allows for greater immunity to electromagnetic interference which can occur on railway tracks. Modulating the signal produced by the transceiver 102 also results in ensuring that neither railway track is always held at a relative common potential.

The modulating scheme may be a combination of quadrature Phase Shift Keying (PSK) and Frequency Shift Keying (FSK) symbols. This may also be combined with Time Division Multiplexing (TDM). Collision detection is required to prevent multiple transmissions over the rail tracks 3000 at once.

The transceiver 102 is adapted to communicate over the rail tracks 3000 using conventional 2-wire modulated communications protocols. In the embodiment shown, the communications protocols use discovery, handshaking and collision detection.

In one embodiment, the carrier frequency is in the range of 400 MHz to 6 GHz. It will be understood by a person skilled in the art, that these frequency ranges may be chosen based on a number of factors surrounding the characteristics of the rail tracks 3000, such as the permeability characteristics of the rail tracks 3000, impedance between the rails and the earth (and hence how much current would leak to earth or between the two rails), contact losses between the wheel commutators, and between the wheels and the tracks, among other things.

Other factors to be considered involve the transmission power of the transmitted signal which may be determined based on a number of factors including, but not limited to, the traction supply coming from the overhead wires, the supply from the third rail (if used) or in the case of diesel locomotives, from the invertor/generator the diesel locomotive would have.

Rail tracks tend to be lossy at larger distances due to their reasonably low conductance, which results in a maximum distance over which the transceiver 102 is limited to communicate over. If it is desired to communicate longer distances, repeaters may be installed along the rail track 3000 to facilitate longer range communications along the rail track 3000 between the plurality of railway vehicles 2000.

Figure 4:
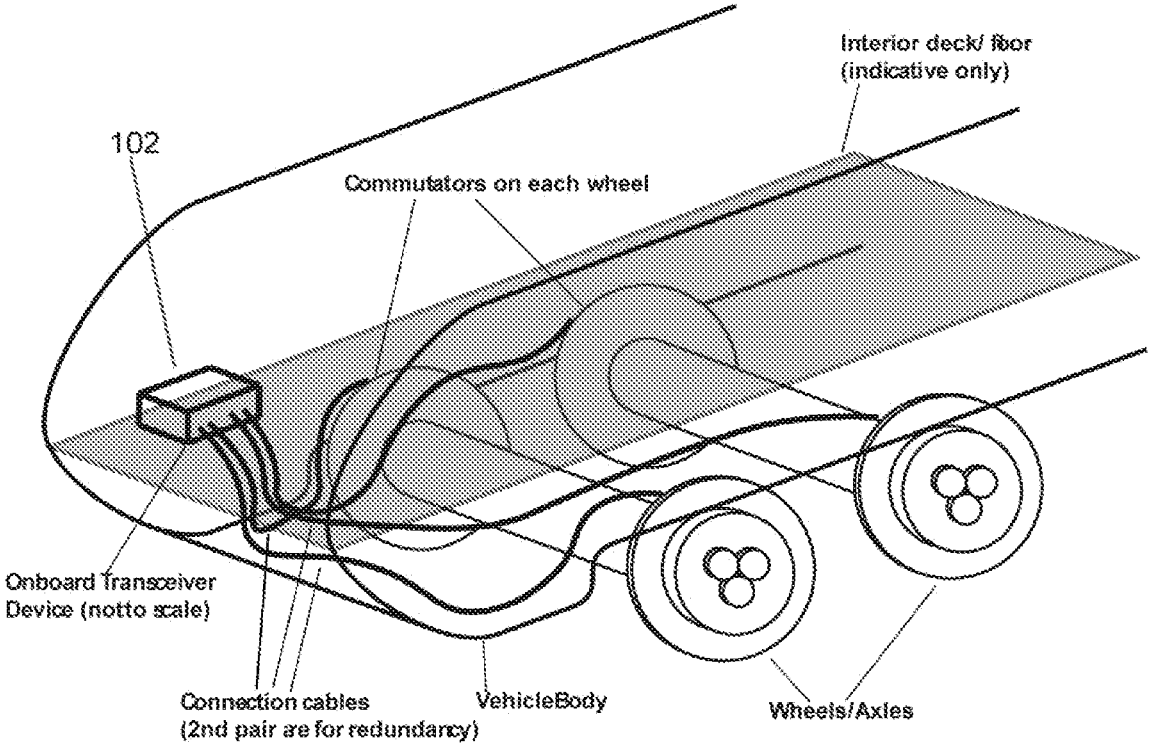
FIG. 4 shows a railway vehicle in accordance with an embodiment of the invention.

In the embodiment shown, the transceiver 102 is electrically connected to the wheels (such as shown in FIG. 4) of the railway vehicle 2000 via the axle of the railway vehicle. In the embodiment shown, the transceiver 102 is electrically connected to the axle of the plurality of rail vehicles 2000 using a commutator which provides an electrical connection between the transceiver and the axle of the plurality of rail vehicles 2000.

Figure 2:
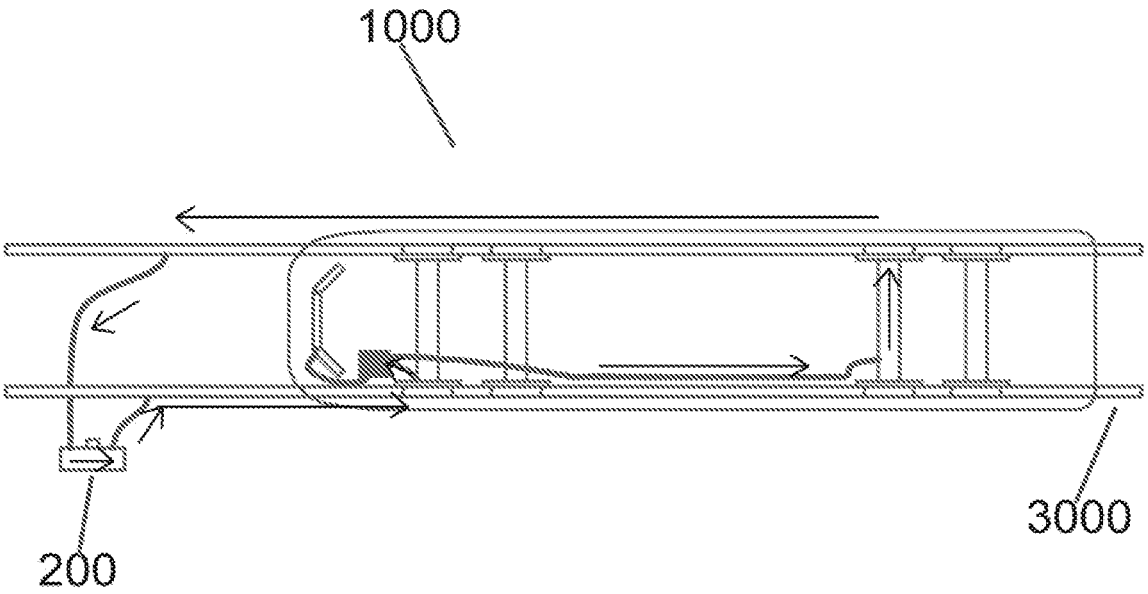
FIG. 2 shows a top view of the system in use.
Figure 5:
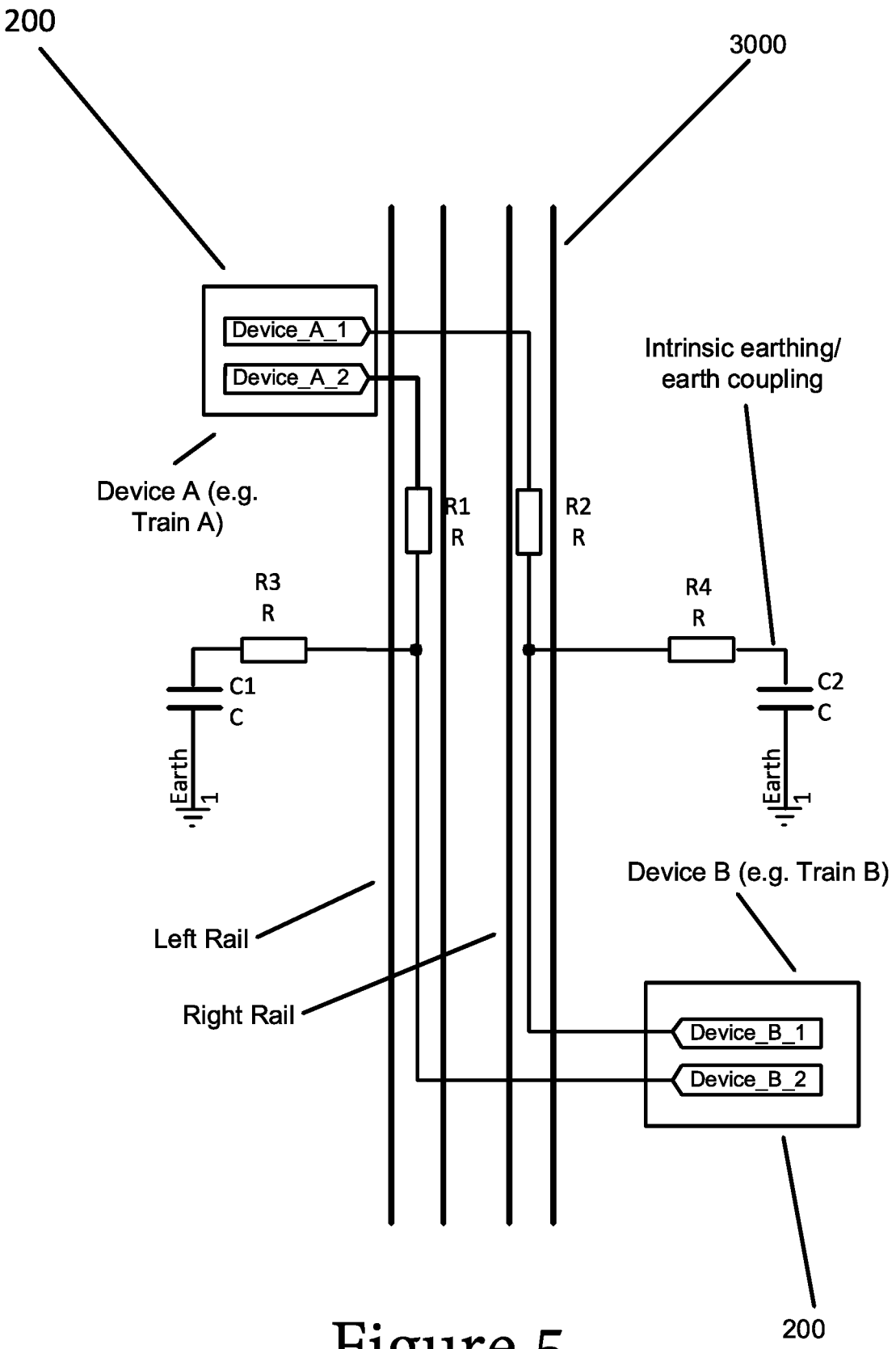
FIG. 5 shows a schematic diagram of a track layout in accordance with an embodiment of the invention.

In other embodiments, as exemplified in FIG. 2 and FIG. 5, trackside/wayside transceivers 200 may be connected to the track using a cable. The transceiver 200 in this instance, would consist of a small box mounted/affixed on the ground, either between two rails 3000 or beside one rail 3000, in close proximity such that cables can be drawn/laid out to connect the box to the rails. The trackside/wayside transceivers 200 would be of similar makeup to the vehicle mounted ones internally but would interface differently with other equipment. For example, it may be powered by a standard mains electrical feed, and hence need a different power input to that used on a vehicle mounted one.

The transceivers 102 commence transmission from a discovery state and transmit AC pulses up and down the rail track to indicate their presence to other railway vehicles, while intermittently listening for pulses from other transceivers. Furthermore, the transceiver 102 is adapted to send out pings to call for other devices and also to detect shorts between the two rail tracks 3000. The shorts can indicate a variety of conditions including, but not limited to, broken rails, obstructions/debris, trains which do not have the system installed, trains which do have the system installed, but the system is not activated.

Furthermore, the discovery state is adapted to detect track circuits by looking for certain DC or AC voltages across the two rails, which could match the profile of a track circuit (e.g., if the system sees 120V AC sine wave at 60 Hz, it can determine beyond a reasonable doubt that it is a track circuit (TC)). Therefore, if the rail vehicle does enter a track circuited area/block, the transceiver 102 can disable itself to prevent interfering with it, then re-enable when it has detected the current coming from the TCs is gone (i.e. it has left the track circuited area).

Once two transceivers 102 come within a predefined distance of each other, the resistance along the section of track 3000 between the railway vehicles will be low enough for the two transceivers to recognise each other's communications. Once this occurs, a standard digital protocol is then used such that each railway vehicle can identify itself and establish a handshake connection utilising the at least one rail track 3000 as a communications medium.

In one embodiment, upon discovering another rail vehicle 2000, the system 1000 then performs a handshake and sets up a peer-to-peer piconet between the two rail vehicles 2000. At the same time, the system 1000 observes for packet collisions coming from other rail vehicles 2000 in the vicinity. The system 1000 is also adapted to look for track defects such as shorts or broken rails.

In an embodiment of the invention, the transceiver 102 is adapted to measure the relative impedance of the rail tracks 3000. This in practice would be performed between two transceivers 102, whereby one shorts its connections to the two rails together, the second one produces an electrical signal and measures the signal which returns back. The second transceiver 102 will then compare the two signals, noting changes in parameters such as amplitude, current etc. and use this to derive a figure for the impedance between the two transceivers.

By then taking into account the conductance per metre (which for rails is generally consistent even over long distances) the transceiver 102 can in turn derive the distance between it and the transceiver 102 which shorted its contacts. If the embodiment has one common conductor however, then one transceiver would simply produce the electrical signal with agreed upon parameters (i.e. specific amplitude, frequency etc.) and the other would listen, compare the received gain with the theoretically expected values, and derive an impedance value from there. In both cases, this orchestrated operation would be performed at regular intervals in a given time frame to repeatedly obtain distance measurements as the vehicles traverse along the track. this in turn also gives them the ability to measure relative speed and acceleration.

In another embodiment, in addition to or instead of determining the impedance of the rail tracks 3000, the transceivers 102 may be adapted to utilise the effects of the time delay in sending transmissions, to measure the time taken for packets to travel between two rail vehicles 2000. This is similar to how GNSS systems measure the relative distance between satellites and ground stations.

Utilising this effect allows each of the rail vehicles 2000 to determine an accurate distance from each other. This may be achieved by transmitting packets from either the front or the rear of the rail vehicles 2000. Alternatively, the use of a "phased array" technique where each vehicle would have at least two transceivers 102 mounted independently, a set distance apart (e.g. one at the front, one at the back) where both are synced together to the same time source, so their measurements are in synchronisation.

The procedure is initialised by each transceiver 102 producing a small data ping, containing the time at which it was sent, and the listening transceiver(s) 102 will each record the timestamp of when the ping was received. By then subtracting the time it was sent from the time it was received, and then after taking into account inherent delays from parameters such as clock shift (where the two transceivers are not synced to the same time) as well as known delays (such as latency in the processing stages of generating the signals) then multiplying it by the speed for the signal to traverse one standard unit of distance of the medium (tracks) in one second, you would obtain the measured distance between those two specific transceivers 102.

In an embodiment of the invention, the transceivers 102 use the following mathematical formula to derive distance:

$$D = v\frac{t_1 + t_2}{2} \qquad \text{Formula 2}$$

Where D is the distance between the two transceivers (m), $t_1$ is the time taken for a transmission to travel from one transceiver to another(s) $t_2$ is the time taken for a transmission to travel the opposite direction back to the original transceiver (s) and v is the standard speed at which the transmission travels in that medium (m/s).

Phased array techniques may also be used to determine the direction of the rail vehicle 2000. Furthermore, the data regarding train direction and distance of the rail vehicles 2000 from each other may be verified using fixed devices mounted to the rail tracks 3000 or wayside. The fixed devices would already know their precise location as well as other sources of location data such as GNSS, to identify their exact location in the network. In one embodiment, by having at least two onboard transceivers on a train, one can also share and compare receiver timestamps between the two transceivers, to understand direction. For example, if the front transceiver hears the pings first, that means that the third transceiver, which is external to the vehicle and transmitting the ping, is towards the front of the train.

In an embodiment of the invention, the doppler effect is used to determine relative velocity and/or acceleration of vehicles, by measuring the shift in frequency of the transmission carrier wave, which would come about through the difference in relative speed, velocity or acceleration. This would work by having one transceiver send out a time-stamped wave at a predetermined frequency, for a predetermined duration. A second transceiver would receive this signal, compare the measured frequency with the expected/predetermined one, determine the difference and in turn derive the difference in velocity from this and known parameters of the transmission medium (e.g., permeability of the rails).

In operation, the system provides for the constant monitoring of distance between the rail vehicles 2000. Furthermore, each transceiver 102 may be adapted to share information between rail vehicles 2000 such related to their driving conditions such as speed, acceleration, incline, nominal braking distance etc. By utilising this information, each rail vehicle 2000 can assess and come to an agreement as to whether or not each rail vehicle 2000 is on a course for collision (i.e. is there a sufficient braking distance to avoid a collision).

In another embodiment, Frequency Division Multiplexing (FDM) may also be used as a transmission protocol. However, such a scheme would not be preferable, as there is no "level of authority".

Figure 3:
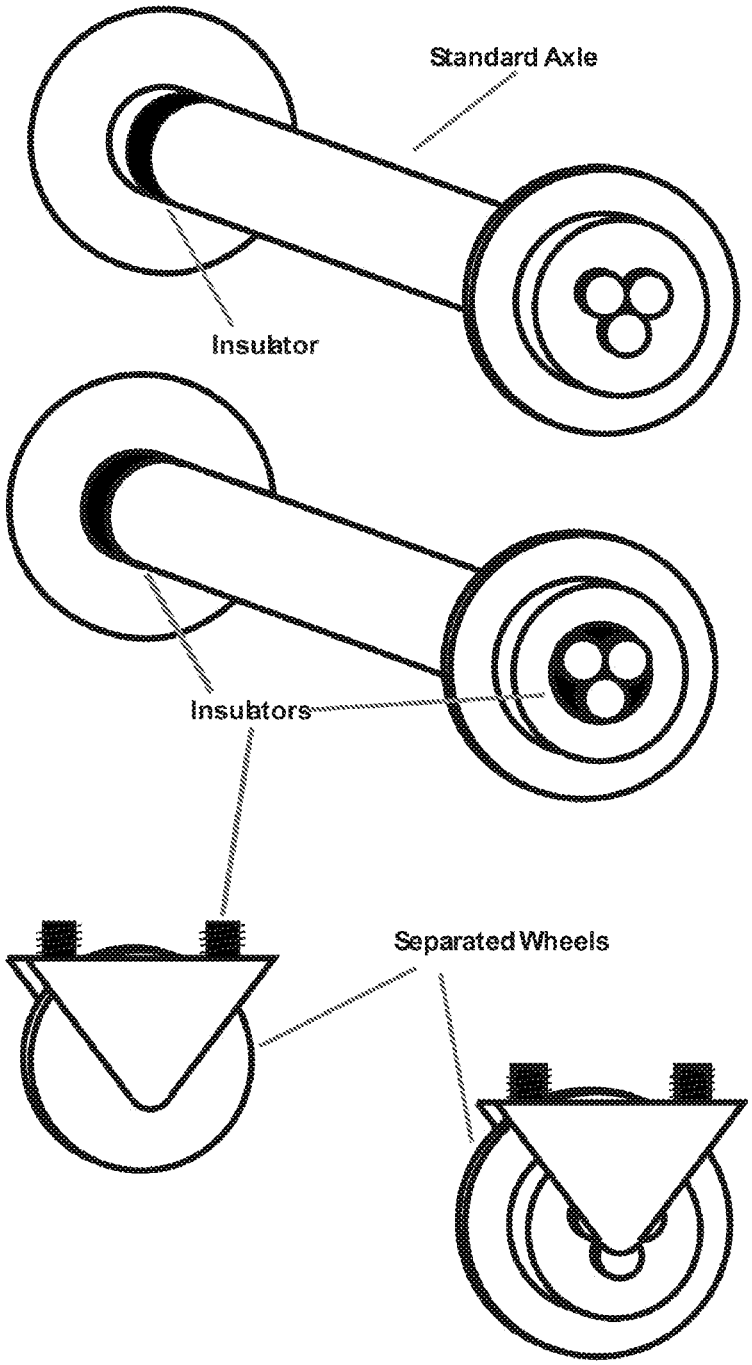
FIG. 3 shows a wheel assembly in accordance with an embodiment of the invention.

FIG. 3 exemplifies possible modifications required to the axle of the rail vehicles 2000 whereby insulators are incorporated into the axle structure to ensure that the axle does not short out the circuit created on the rail tracks 3000 for communications between the rail vehicles 2000. The insulators may be created using dielectric materials such as ceramic or polymer insulating materials. It is envisaged that these modifications would be performed at the time that the rail vehicle 2000 is fabricated or may be retrofitted in the case that the rail vehicles 2000 are presently in use.

Figure 6:
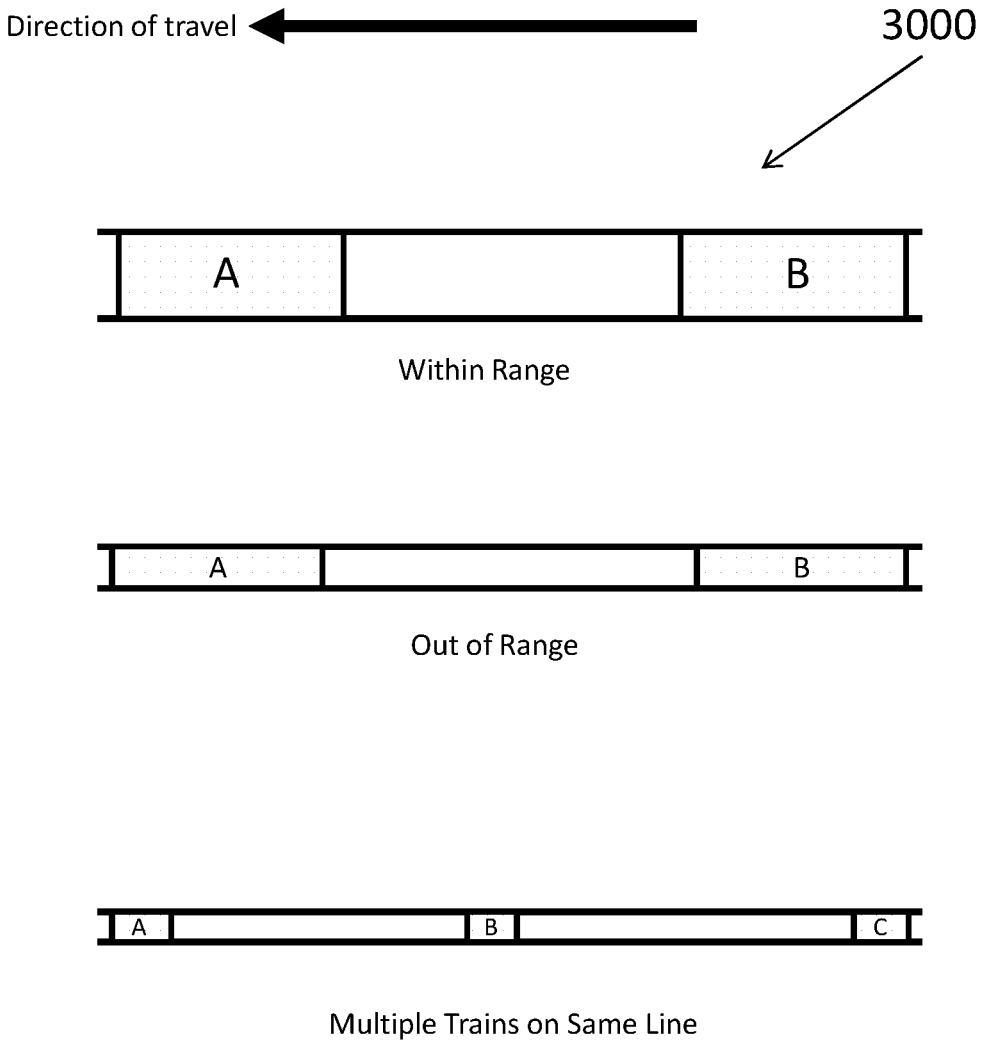
FIG. 6 shows various transmission ranges in accordance with the present invention.

FIG. 6 exemplifies various ranges that rails vehicles, represented by "A", "B" and "C" in the diagrams, may be within a range of communication. In the top diagram labelled "Within Range", the rail vehicles 2000 labelled "A" and "B" respectively, are within a suitable range to send and receive signals from each other over the rail tracks 3000. In the second, diagram labelled "Out of Range", the rail vehicles 2000 labelled "A" and "B" respectively are sufficiently spaced apart that effective communications are not reliable or indeed possible due to the impedance characteristics of the rail tracks 3000. However, in this situation the rail vehicles 2000 would be at a sufficiently safe distance from each other such that the risk of a collision would be minimal. The third diagram in FIG. 6, represents a situation where multiple rail vehicles 2000, shown as "A", "B" and "C" respectively, are occupying a rail track 3000 in which case the rail vehicle represented by "B" may communicate with rail vehicles A" and "C" simultaneously.

Figure 7:
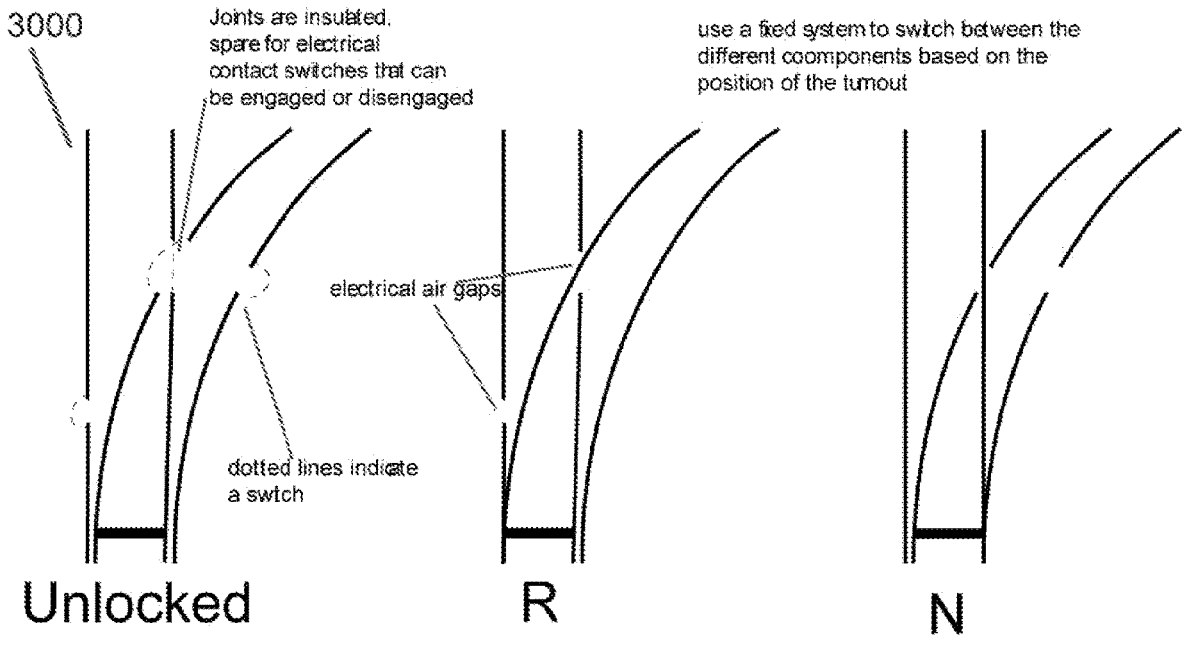
FIG. 7 shows a track configuration in accordance with an embodiment of the present invention.
Figure 7:
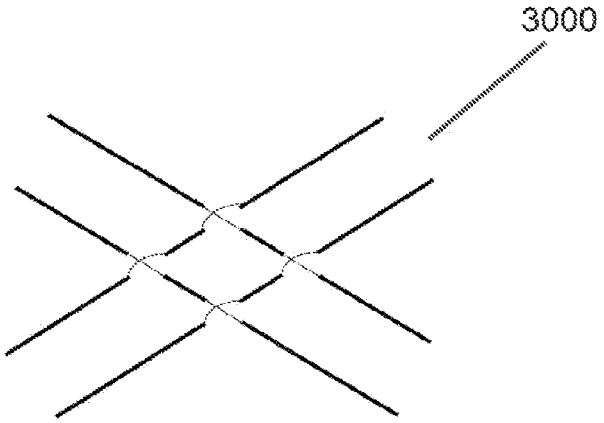

FIG. 7 represents various rail track junctions (turnouts) showing the location of electrical contact switches located at the junctions that can be engaged or disengaged. The use of switches allows for the maintenance of electrical continuity along the rail tracks 3000 as is required to maintain a circuit for communications between the rail vehicles 2000. The switches may be actuated using an electromechanical actuator such as a solenoid. The solenoid may be actuated remotely by use of a cable operated system or potentially via wireless control utilising any of the wireless protocols previously mentioned.

More Detail on Distance Measurement

A quirk of using electrical communication is that the line (in this case the rails) will have a negligible resistance (or more broadly impedance). Moreover, given that the rails hold a standard profile, this means that if you measure the impedance across a length of rail, and you know the standard impedance per unit length, you can derive the length of that rail.

Another quirk is that there will be an inherent time delay, small but measurable, associated with any transmission. Again, this is predictable based on environmental constants so if it is possible to measure time delay, and how long it takes to traverse over a unit length, it is possible to determine the distance a signal has travelled.

Thus, two trains can measure the distance between themselves in two ways. The first method works by coordinating a line impedance test, whereby one train will short its two wheels together, and another will send an AC signal along one line. The signal will go through the short of the first train, returning back to the train that sent it, and by comparing the power of the received transmission with the sent, they can work out the resistance. From here it is simply a matter of negating the impedance of the trains' wheels, then divide by the standard impedance of the rail per metre, then divide by half again (since there are two rails) and you know exactly how far away you are away from each other.

Note that the first method fundamentally requires the transmitting train to alter its voltage and/or current output (power) in response to the impedance load experienced. Thus, in effect, the method requires a transmission method, technique or process which allows for the alteration of output power, as power is equal to the product of current and voltage. This output power in any given utilisation scenario may be either derived, reached or realised, based on a multitude of parameters including but not limited to power input, vehicular headway, driving conditions and perceived alertness of the driver (if any).

The second method of estimating distance is a bit more nuanced and involves more complex mathematics. Each of the two trains require at least two transceiver devices (e.g. front and back). Each device will send out timestamped pings for other transceivers to receive. They each compare and share the sent timestamps with the received ones, then using this information can perform a 1-dimensional triangulation calculation (taking into account time drift as the clocks onboard both trains will not be in perfect sync), and the end result is substantially the same as the first method. This is effectively a simplified version of how GPS works, but the benefit is that it only needs one logical conductor, so it can work without complex changes to the insulative properties of the wheels, axles or tracks that are required as part of the first method.

The second method does not strictly necessitate a changing power output as in the first method, the nominal or maximum power output of such a transmission in this case, would be decided upon either by a person skilled in the art, or the system itself, based on a number of factors, including the input power as well as the desired headway of the vehicle (as the latter ultimately decides the maximum linear distance along the tracks to which the vehicle can practically communicate.)

Usage of Distance Measurement & Communication

In an embodiment of the invention, upon obtaining the distance, relative speeds and accelerations between two or more rail vehicles using methods outlined previously, the transceivers in a given scenario can compare these calculations with a known understanding of safe headway to determine if they are in a situation which is unsafe. For example, if a given rail vehicle is within its braking curve it can identify that in an emergency braking application, it would still collide with the train in front. Thus, the vehicle as a whole has an informed understanding of if it is safely distanced from other vehicles.

In an embodiment of the invention, the onboard transceiver is connected to other electrical, electromechanical and/or mechanical systems, such as (but not limited to) those used to manage and operate braking, control systems used to manage train ordering, signalling systems used to manage rail traffic or those used to interface with human drivers. These systems in addition to the transceiver can communicate over other communications mediums (outside the scope of this patent specification) and work collaboratively to ensure the train travels in a safe manner. Such examples of operations may include but are not necessarily limited to applying penalty brakes if the vehicle comes too close to another vehicle, accelerating the train to avoid another train approaching from behind, providing detailed location information to other systems and triggering additional vigilance checks in situations where the alertness of human drivers is more critical.

In an embodiment of the invention, fixed transceivers can communicate with onboard transceivers to collaboratively assist in maintaining safety. Such examples of operations include, but are not necessarily limited to, providing information to the onboard systems about track conditions (e.g., weather, gradients, curvatures etc.) which the onboard system would use to alter its speed, providing location information for the purposes of calibrating distance measurements or obtaining an environmental understanding, relaying information between the vehicle and the fixed signalling system (and in turn the network control centre(s)) and denying rail vehicles the authority to move in certain situations where it is warranted (as an example, when setting up a temporary trackwork worksite, the fixed transceiver can command an approaching rail vehicle to stop at the border of the worksite and not to enter. As another example, a signaler can use the fixed transceivers to issue movement authority, in a similar fashion to how they would with other railway signalling systems).

Interpretation

Unless specifically stated otherwise, as apparent from the following discussions, it is appreciated that throughout the specification discussions utilizing terms such as "processing," "computing," "calculating," "determining", "analysing" or the like, refer to the action and/or processes of a computer or computing system, or similar electronic computing device, that manipulate and/or transform data represented as physical, such as electronic, quantities into other data similarly represented as physical quantities.

In a similar manner, the term "controller" or "processor" may refer to any device or portion of a device that processes electronic data, e.g., from registers and/or memory to transform that electronic data into other electronic data that, e.g., may be stored in registers and/or memory. A "computer" or a "computing machine" or a "computing platform" may include one or more processors.

The terms "Rail Vehicle," "Railway Vehicle," "Vehicle," "Rolling stock" and "Train" may be used interchangeably in this document and can be interpreted as encompassing one and the same.

The terms "Headway", "Trains per Hour", "distance between two trains", "desired braking distance" and "braking distance" may be used interchangeably in this document and can be interpreted as referring to specific measurements, parameters or qualities of the same broader concept, that being the linear distance between two vehicles along a section of track, and inversely the number of vehicles which traverse over a given distance of track per unit time.

Reference throughout this specification to "one embodiment", "some embodiments" or "an embodiment" means that a particular feature, structure or characteristic described in connection with the embodiment is included in at least one embodiment of the present disclosure. Thus, appearances of the phrases "in one embodiment", "in some embodiments" or "in an embodiment" in various places throughout this specification are not necessarily all referring to the same embodiment. Furthermore, the particular features, structures or characteristics may be combined in any suitable manner, as would be apparent to one of ordinary skill in the art from this disclosure, in one or more embodiments.

As used herein, unless otherwise specified the use of the ordinal adjectives "first", "second", "third", etc., to describe a common object, merely indicate that different instances of like objects are being referred to, and are not intended to imply that the objects so described must be in a given sequence, either temporally, spatially, in ranking, or in any other manner.

In the claims below and the description herein, any one of the terms comprising, comprised of or which comprises is an open term that means including at least the elements/features that follow, but not excluding others. Thus, the term comprising, when used in the claims, should not be interpreted as being limitative to the means or elements or steps listed thereafter. For example, the scope of the expression a device comprising A and B should not be limited to devices consisting only of elements A and B. Any one of the terms including or which includes or that includes as used herein is also an open term that also means including at least the elements/features that follow the term, but not excluding others. Thus, including is synonymous with and means comprising.

It should be appreciated that in the above description of exemplary embodiments of the disclosure, various features of the disclosure are sometimes grouped together in a single embodiment, Fig., or description thereof for the purpose of streamlining the disclosure and aiding in the understanding of one or more of the various inventive aspects. This method of disclosure, however, is not to be interpreted as reflecting an intention that the claims require more features than are expressly recited in each claim. Rather, as the following claims reflect, inventive aspects lie in less than all features of a single foregoing disclosed embodiment. Thus, the claims following the Detailed Description are hereby expressly incorporated into this Detailed Description, with each claim standing on its own as a separate embodiment of this disclosure.

Furthermore, while some embodiments described herein include some but not other features included in other embodiments, combinations of features of different embodiments are meant to be within the scope of the disclosure, and form different embodiments, as would be understood by those skilled in the art. For example, in the following claims, any of the claimed embodiments can be used in any combination.

In the description provided herein, numerous specific details are set forth. However, it is understood that embodiments of the disclosure may be practiced without these specific details. In other instances, well-known methods, structures and techniques have not been shown in detail in order not to obscure an understanding of this description.

Similarly, it is to be noticed that the term coupled, when used in the claims, should not be interpreted as being limited to direct connections only. The terms "coupled" and "connected," along with their derivatives, may be used. It should be understood that these terms are not intended as synonyms for each other. Thus, the scope of the expression a device A coupled to a device B should not be limited to devices or systems wherein an output of device A is directly connected to an input of device B. It means that there exists a path between an output of A and an input of B which may be a path including other devices or means. "Coupled" may mean that two or more elements are either in direct physical, electrical or optical contact, or that two or more elements are not in direct contact with each other but yet still co-operate or interact with each other.

Embodiments described herein are intended to cover any adaptations or variations of the present invention. Although the present invention has been described and explained in terms of particular exemplary embodiments, one skilled in the art will realize that additional embodiments can be readily envisioned that are within the scope of the present invention.

What is claimed is:

1. A rail-based system for communication between a plurality of railway vehicles, the system comprising:

a contact adapted for providing an electrical connection between at least one of the plurality of railway vehicles and at least one rail track;

a transceiver associated with at least one of the plurality of railway vehicles, the transceiver being adapted to transmit and/or receive an electrical signal by way of the contact from the at least one of the plurality of railway vehicles to and/or from the at least one rail track;

wherein, the electrical signal is transmitted and/or received over the at least one rail track to communicate between the plurality of railway vehicles;

wherein the transceiver is adapted to adjust a power output of the electrical signal to determine a distance between the plurality of railway vehicles; and wherein the power output of the electrical signal is derived based on a function of one or both of a headway, and/or power input.

2. The system of claim 1, wherein the distance between the plurality of railway vehicles is determined using the formula:

$$D = \frac{Z_m - Z_a}{2Z_u} = \frac{\frac{V_i - V_o}{I_o} - Z_a}{2Z_u}$$

wherein D equals a distance between the transceiver associated with the at least one of the plurality of the railway vehicles (in metres), Vi is the input voltage of the transceiver, Vo is the voltage received by the transceiver and Io is the current measured in Amperes.

3. The system of claim 1, wherein the function further depends on at least a parameter of the plurality of railway vehicles.

4. The system of claim 1, wherein the function includes the parameters of:

perceived alertness of a human driver;

weather conditions which would affect safe travelling speeds;

gradient of track;

curvature of track;

whether or not authority to move has been granted to the vehicle by a higher operational entity (e.g., a network controller); or presence of additional hazards such as worksites, incident scenes, infrastructure faults.

5. The system of claim 1, wherein the power output of the electrical signal is proportional to a headway of the plurality of railway vehicles.

6. The system of claim 1, wherein the system further includes a transceiver installed trackside to communicate with the transceiver associated with the at least one of the plurality of railway vehicles.

7. The system of claim 5, wherein the railway vehicle is adapted to adjust the headway, braking conditions, velocity and/or acceleration depending on parameters of the at least one of the plurality of railway vehicles.

8. The system of claim 1, wherein the transceiver is adapted to produce a modulated signal.

9. The system of claim 1, wherein the transceiver is adapted to use latency measurements with respect to delays in transmission time to determine a distance between the at least one of the plurality of railway vehicles.

10. The system of claim 1, wherein the transceiver is adapted to measure the electrical characteristics of the at least one rail track between two transceivers, to determine a distance between the at least one of the plurality of railway vehicles.

11. The system of claim 1, wherein the transceiver is adapted to measure or utilise the doppler effect to calculate the relative distance, speed, velocity and/or acceleration to determine a distance between the at least one of the plurality of railway vehicles.

12. The system of claim 1, wherein the transceiver is adapted to adjust output power of the electrical signal to increase/decrease with a distance that the electrical signal travels.

13. The system of claim 1, wherein the electrical signal is alternatively transmitted utilising overhead wiring (OHW).

14. The system of claim 1, wherein GNSS, GPS or other satellite based geodesic geolocation systems is used to aid in locating the at least one of the plurality of railway vehicles.

15. The system of claim 1, wherein cellular or telephony communications technologies are used to aid in locating the at least one of the plurality of railway vehicles, or as an alternative method of communication between the at least one of the plurality of railway vehicles.

16. The system of claim 1, wherein IP based communications technologies are used to aid in locating the at least one of the plurality of railway vehicles, or as an alternative method of communication between the at least one of the plurality of railway vehicles and/or other fixed systems.

17. The system of claim 1, wherein NFC communications technologies are used to aid in locating the plurality of railway vehicles, or as an alternative method of communication between the at least one of the plurality of railway vehicles and/or other fixed systems.

18. The system of claim 1, wherein the system is used alongside or in conjunction with traditional signalling systems (which can be classed as having a grade of automation of 0) as an ancillary method of protection, an additional safety system and/or to aid in locating the at least one of the plurality of railway vehicles.

19. The system of claim 1, wherein the system is used alongside or in conjunction with signalling technologies as an ancillary method of protection, an additional safety system and/or to aid in locating the at least one of the plurality of railway vehicles.

20. The system of claim 1, wherein the contact is adapted for providing an electrical connection between each of the at least one of the plurality of railway vehicles and at least one rail track.

* * * * *